US006571772B1

(12) United States Patent
Ott et al.

(10) Patent No.: US 6,571,772 B1
(45) Date of Patent: Jun. 3, 2003

(54) METHOD FOR STARTING AN INTERNAL COMBUSTION ENGINE HAVING SEVERAL CYLINDER BANKS AND BEING OPERATED WITH GASOLINE DIRECT INJECTION

(75) Inventors: Karl Ott, Markgroeningen (DE); Gerd Grass, Schwieberdingen (DE); Lilian Kaiser, Stuttgart (DE); Peter Klee, Knittlingen (DE); Ruediger Weiss, Moetzingen (DE)

(73) Assignee: Robert Bosch GmbH, Stuttgart (DE)

( * ) Notice: Subject to any disclaimer, the term of this patent is extended or adjusted under 35 U.S.C. 154(b) by 169 days.

(21) Appl. No.: 09/654,414

(22) Filed: Sep. 1, 2000

(30) Foreign Application Priority Data

Sep. 1, 1999 (DE) ..... 199 41 539

(51) Int. Cl.[7] ..... F02D 17/02; F02D 41/06

(52) U.S. Cl. ..... 123/481; 123/491; 701/104; 701/113

(58) Field of Search ..... 123/481, 491, 123/198 F, 198 DB, 198 D; 701/104, 112, 113

(56) References Cited

U.S. PATENT DOCUMENTS 4,998,522 A * 3/1991 Achleitner ..... 123/491
5,540,633 A * 7/1996 Yamanaka et al. ..... 123/198 F
5,690,073 A * 11/1997 Fuwa ..... 123/443
5,778,858 A * 7/1998 Garabedian ..... 123/481
5,797,371 A * 8/1998 Nonaka ..... 123/406.23
5,826,563 A * 10/1998 Patel et al. ..... 123/198 F
5,884,603 A * 3/1999 Matsuki ..... 123/198 F
6,125,812 A * 10/2000 Garabedian ..... 123/198 F

FOREIGN PATENT DOCUMENTS

| | | | | |
|---|---|---|---|---|
| DE | 2325060 | | 12/1973 | |
| DE | 197 41 966 | | 4/1999 | |
| DE | 10042842 | A1 * | 3/2001 | ..... F02B/3/04 |
| EP | 0 371 158 | | 6/1990 | |
| EP | 0 640 762 | | 3/1995 | |
| FR | 2186067 | | 12/1973 | |
| JP | 3275949 | * | 12/1991 | ..... F02D/17/02 |
| JP | 90582 | * | 4/2001 | ..... F02D/41/06 |

* cited by examiner

*Primary Examiner*—Hieu T. Vo
*Assistant Examiner*—Hai Huynh
(74) *Attorney, Agent, or Firm*—Walter Ottesen

(57) ABSTRACT

The invention is directed to a method of starting an engine for internal combustion engines of a motor vehicle driven by gasoline direct injection with the engines being subdivided into several cylinder banks and a high pressure injection system being provided for each cylinder bank. During a first phase (A), an injection into the cylinders of a first cylinder bank in correspondence to their normal ignition sequence takes place and no injection is carried out in the cylinders of the remaining cylinder banks. In a subsequent second phase (B), injection takes place also into the cylinders of the other cylinder bank or banks.

10 Claims, 3 Drawing Sheets

METHOD FOR STARTING AN INTERNAL COMBUSTION ENGINE HAVING SEVERAL CYLINDER BANKS AND BEING OPERATED WITH GASOLINE DIRECT INJECTION

FIELD OF THE INVENTION

The invention relates to a method for starting an internal combustion engine operated with gasoline direct injection. The engine is subdivided into several cylinder banks and a high-pressure injection system is provided for each cylinder bank.

BACKGROUND OF THE INVENTION

The gasoline direct injection is carried out in a spark-ignition engine utilized in a motor vehicle with a high-pressure injection system. The high pressure, which is necessary for an optimal combustion in the cylinders, must be built up over a few seconds after each engine start. For this reason, the actual starting operation takes place at a significantly lower prepressure of the electric fuel pump.

For a cold start of the engine at low prepressure, there are however very large fuel quantities to be injected in order to ensure a reliable combustion. This combustion is however not optimal and a high consumption of fuel occurs with correspondingly high exhaust gas emissions. The first cold start injection operations ensure a very slow buildup of the high pressure because of the large fuel quantities which are taken from the high pressure rail. In the early start phase, the pressure in the high pressure rail lies even below the prepressure because of the pressure losses between the electric fuel pump and the high pressure rail.

The engine speed (rpm) during the first combustions increases rapidly. For this reason, the time shortens which is available for the subsequent injections. For this reason, the desired large fuel quantity cannot be timely injected in advance of the particular ignition. The corresponding smaller injected fuel quantity does not combust reliably and misfires can occur with a corresponding deterioration of the composition of the exhaust gas. In this way, a continuous increase in rpm is prevented and the engine speed alternately collapses and increases until the rpm is stable after several seconds and the start operation is ended.

SUMMARY OF THE INVENTION

It is an object of the invention to provide a method for a rapid and reliable engine start of gasoline direct injection internal combustion engines having several cylinder banks in that the above-described deficiencies such as the slow buildup of the high pressure, high fuel consumption, high exhaust-gas emissions and the problem of misfires are reduced or are avoided.

The method of the invention is for starting an internal combustion engine operated with direct injection including an engine for a motor vehicle, the engine being subdivided into several cylinder banks with high-pressure injection systems being provided for corresponding ones of the cylinder banks. The method includes the steps of: injecting each of the cylinders of a first one of the cylinder banks in a first phase (A) while not injecting the cylinders of the remaining one(s) of the cylinder banks; and, in a subsequent second phase (B), injecting those cylinders of a second one of the cylinder banks.

The advantage of the invention is that the start operation is first initiated only on one cylinder bank with fuel prepressure in an internal combustion engine having gasoline direct injection and having several cylinder banks with each cylinder bank having a high pressure system. Thereafter, the other cylinder banks can be switched in at higher fuel pressure.

The method according to the invention includes the embodiments presented below.

Basically, for each type of engine, an individual determination can be made as to whether or when each individual injection valve should inject during a cold start phase.

EXAMPLE (a)

In a multi-bank engine, an injection once or several times into all cylinders of the first cylinder bank can take place and then once or several times into all cylinders of the remaining cylinder banks and thereafter into all cylinders of all cylinder banks in accordance with the normal ignition sequence. It can be individually determined which cylinder bank will be injected first and how the sequence of the injection will be for the remaining cylinder banks.

EXAMPLE (b)

In a multi-bank engine and depending upon the requirements, one or several injections into all cylinders of a first cylinder bank takes place and thereafter into all cylinders in accordance with the normal ignition sequence. Here too, it can be individually determined which cylinder bank will be injected first.

EXAMPLE (c)

In a multi-bank engine, and depending upon demand, injection can be sequentially into different cylinder banks and only thereafter into all cylinders of all cylinder banks in accordance with the normal ignition sequence. The sequence of the cylinder banks into which injection is to be made is in principle freely selectable or can be individually fixed depending upon the type of engine. Within this sequence, injection can also be made simultaneously into several cylinder banks.

Furthermore, the following can be fixed in a multi-bank engine: time point, frequency and sequence of the injections into individual cylinder banks in dependence upon the fuel high pressure measured in each case. If required, this can be individually determined in each starting operation.

In the method in accordance with the invention, the fuel high pressure system is subdivided in correspondence to the engine banks and an injection suppression strategy is executed for the cold start. In addition to this method of the invention, a variable rail volume or a variable pumping characteristic of the electric high pressure pump can contribute to a more rapid cold start and a more rapid high pressure buildup with a simultaneous lower fuel consumption and lower exhaust gas emission.

The realization of the method of the invention in the form of a control element is of special significance. The control element is provided for a control apparatus of an internal combustion engine and especially for a motor vehicle. A program is stored on the control element and is suitable for running on a computing apparatus and especially on a microprocessor and is suitable for executing the method of the invention. In this case, the invention is realized by a program stored on the control element so that this control element, which is provided with the program, defines the invention in the same way as the method for which the program is suitable for executing. Especially an electric storage medium can be used as a control element, for example, a read-only-memory.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
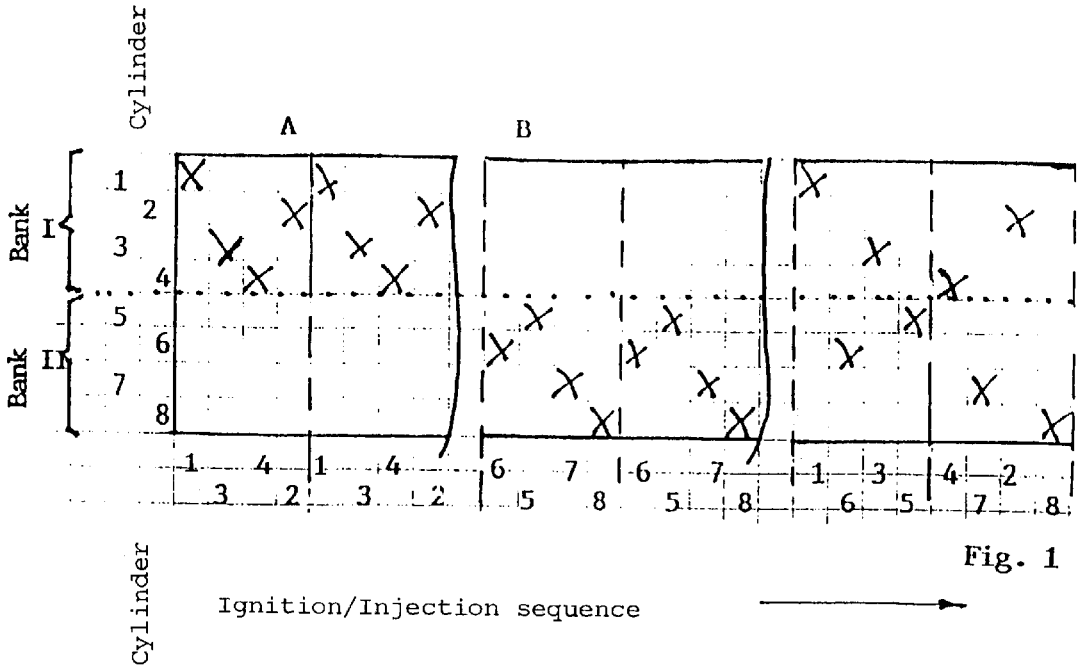
FIG. 1 is a schematic showing the injection sequence in accordance with a first embodiment of the engine start method according to the invention applied to an eight-cylinder engine subdivided into two banks.

FIG. 1 shows a first embodiment of the method of the invention. The ignition/injection sequence is plotted along the abscissa and the cylinder sequence of an eight-cylinder internal combustion engine having gasoline direction injection is plotted in the ordinate direction. The eight-cylinder engine is subdivided into two cylinder banks I and II. A fuel high-pressure accumulator is assigned to each of the two cylinder banks. In the embodiment shown in FIG. 1, fuel is injected several times into all cylinders of bank I (first cylinder bank) in a first phase A in the usual ignition/injection sequence 1-3-4-2. Then, in phase B, fuel is injected several times into the cylinders 5 to 8 of bank II (second cylinder bank) in the ignition/injection sequence 6-5-7-8 and finally, fuel is injected into all cylinders 1 to 8 of both cylinder banks I and II in the normal ignition/injection sequence 1-6-3-5-4-7-2-8.

Figure 4:
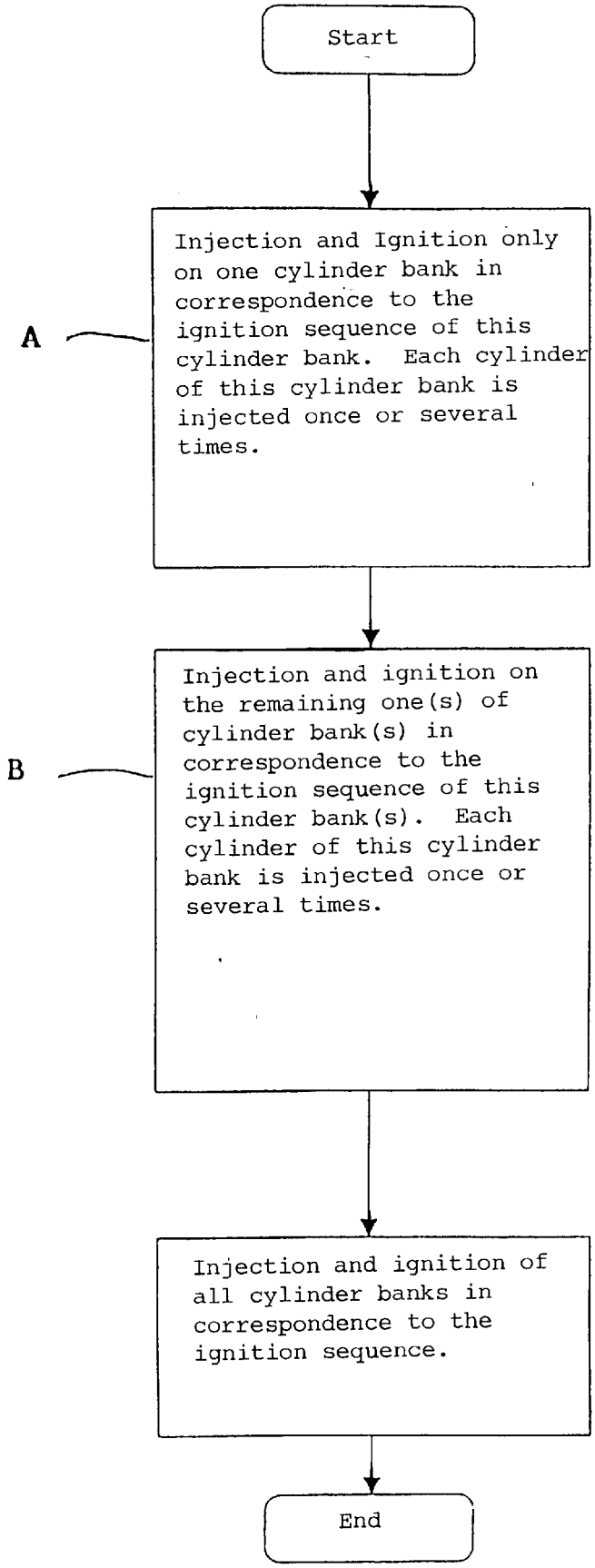
FIG. 4 is a flowchart of a program which can be run to execute the first embodiment of the motor start method of the invention; and, FIG. 5 is a flowchart showing a further embodiment of the engine start method according to the invention.

The embodiment of the method of the invention shown graphically in FIG. 1 is presented in FIG. 4 in the form of a flow diagram showing the method steps of this embodiment. In FIG. 4, the two phases A and B of the engine start method are also shown. Corresponding to FIG. 4, the method can also be applied to more than two cylinder banks.

Figure 2:
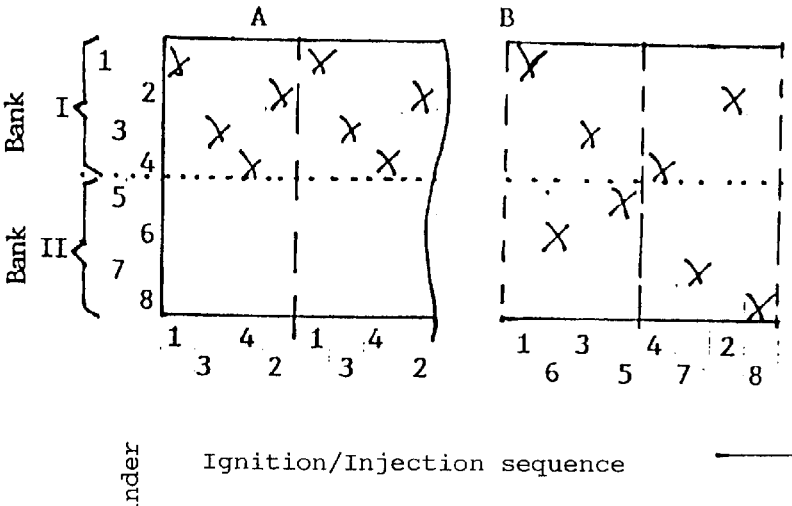
FIG. 2 is a schematic showing the injection sequence of a second embodiment of the motor start method according to the invention.

FIG. 2 shows graphically the ignition/injection sequence of the second embodiment of the engine start method according to the invention for an eight-cylinder internal combustion engine having gasoline direct injection with the engine having two cylinder banks I and II. A separate fuel high-pressure accumulator is, in turn, assigned to each of the cylinder banks. As in FIG. 1, the ignition/injection sequence is plotted in the direction of the abscissa and the cylinder sequence is plotted in the ordinate direction. In this embodiment, all cylinders of the first bank I are injected in phase A in the ignition sequence 1-3-4-2 and then, in phase B, all cylinders 1 to 8 are injected in accordance with the normal ignition sequence 1-6-3-5-4-7-2-8.

Figure 3:
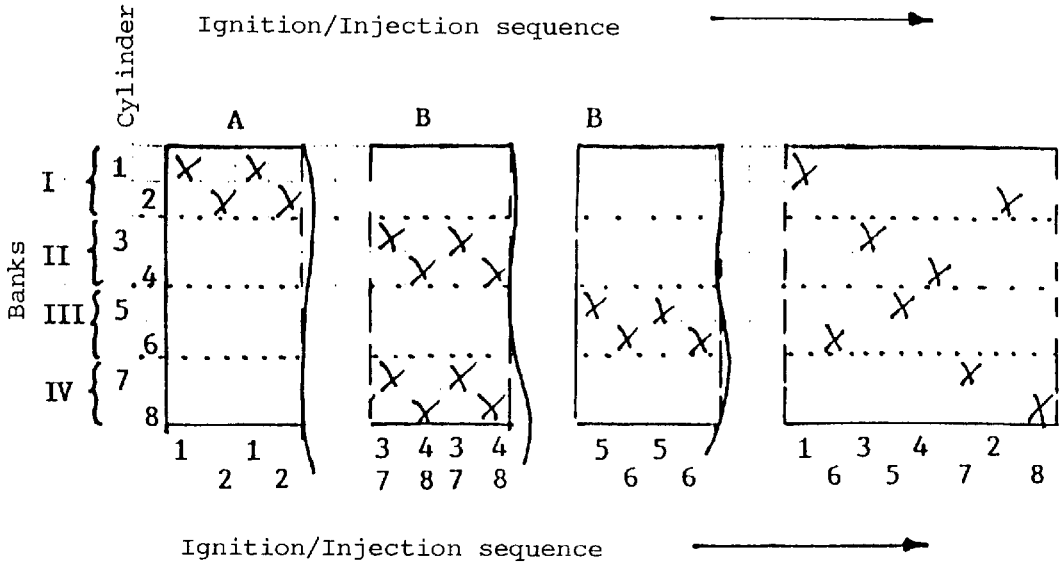
FIG. 3 is a schematic showing the injection sequence of a third embodiment of the motor start method according to the invention applied to an eight-cylinder engine subdivided into four banks.

Finally, FIG. 3 graphically shows a third embodiment of the method of the invention wherein, as an example, an eight-cylinder internal combustion engine having gasoline direct injection and separate fuel high pressure reservoirs is assumed. The eight-cylinder engine is subdivided into four cylinder banks I to IV. First, injection is into the first cylinder bank I in phase A and then, in phase B, the cylinder banks II and IV are simultaneously injected and, thereafter, injection is into the cylinder bank III and finally injection takes place into all eight cylinders of all cylinder banks I to IV in accordance with the normal ignition/injection sequence.

As mentioned, the sequence of the cylinder banks into which the injection takes place in accordance with the method of the invention can, in principle, be freely selectable. For this reason, the embodiment shown in FIG. 3 can be modified in the following way. For example, injection can be first into bank II, then into bank I, then into banks III and IV and then into all cylinder banks or, for example, first into bank IV, then into the banks I and II and then into all four banks in accordance with the normal ignition/injection sequence.

Figure 5:
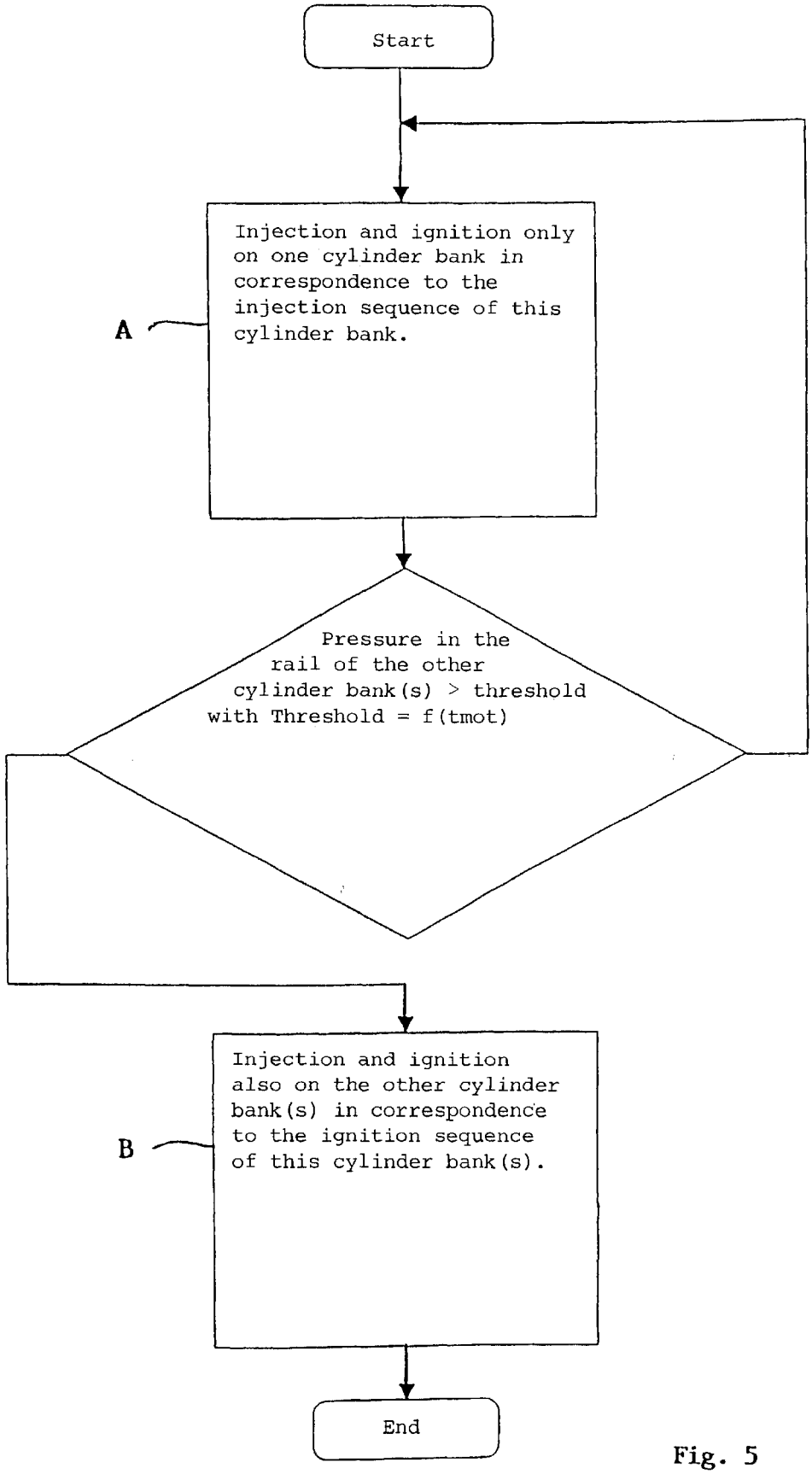

A further alternative is the individual setting, for example, for each starting operation, of: the time point, the frequency and the sequence of the injections into the individual cylinder banks in dependence upon the fuel high pressure applied in each case. FIG. 5 shows the last-mentioned alternative in the form of a flow diagram showing method steps. According to the invention, in a first phase A, injection is only into one cylinder bank corresponding to the ignition sequence of this bank. Then, the pressure in the rail of the other cylinder bank or of the other cylinder banks is detected and a comparison is carried out as to whether this pressure is greater than a threshold value. The threshold value can be a function of the temperature of the engine. If the inquiry carried out in the second step supplies a positive result, that is, when the pressure in the rail of the other cylinder bank or of the other cylinder banks is greater than the threshold value, the injection and the ignition takes place in a phase B also on the other cylinder bank or the other cylinder banks in correspondence to the ignition sequence of the particular cylinder bank. If the result of the inquiry in the second step is negative, then injection and ignition takes place in only the cylinders of the first cylinder bank in correspondence to the ignition sequence thereof.

When a series engine has at least five cylinders, the fuel high pressure system thereof can be subdivided in the sense of the invention and injection can be first into each second cylinder in correspondence to the method strategy of the invention. Each second cylinder then corresponds to a first cylinder bank. Thereafter, injection can be into all cylinders in accordance with the normal ignition sequence.

From the above description, it is clear that the engine start method according to the invention makes possible a rapid and reliable engine start in internal combustion engines having gasoline direct injection with the engine being subdivided into several cylinder banks. This is achieved in that, after a start signal, an injection takes place first into the cylinders of only one cylinder bank. In this way, the first ignition operations are at more than double the time interval. The rpm increase therefore first takes place slower because additional friction work and pumping work must be developed for the remaining cylinder banks which are dragged along. All large fuel quantities, which are required to ensure the combustion in the cylinders of the first cylinder bank, can be injected with greater reliability because of the slower rpm increase, that is, a reduced probability of a misfire is present.

During the above, pressure can build up very rapidly in the other cylinder banks because here no injection operations and therefore no pressure collapses take place.

After a one-time or several-time injection into all cylinders of the first cylinder bank, the injection valves of the cylinder banks, which have up to now only been dragged along, inject exclusively. Alternatively, and as described, injection into all cylinders of all cylinder banks can take place in their normal ignition/injection sequence even after a one-time or several-time injection into the cylinders of the first bank. The cylinders of the cylinder banks, which were first dragged along, inject only smaller fuel quantities because of the already high pressure. For this reason, the cylinders do not effect any large pressure collapses in their high pressure system specific to a bank and they contribute to a more rapid increase in rpm. The smaller fuel quantities can be completely injected and ignited with greater probability notwithstanding the continuous increase in rpm.

While injection takes place into the cylinders of the cylinder banks, which are first dragged along, the high pressure in the high-pressure system of the first cylinder bank can be quickly built up because no injection operations and no pressure collapses take place here.

After injection has taken place once into all cylinders, all injection operations take place in accordance with the normal ignition sequence in a very rapid sequence at high pressure and with small fuel quantities.

Overall, the desired engine idle rpm can be reached more rapidly and the start operation is therefore shortened and takes place with reduced gasoline consumption. In this way, the exhaust-gas emissions during the start operation are reduced and the problem of misfires is reduced.

The engine start method according to the invention wherein the fuel high pressure system is subdivided in accordance with the subdivision into several cylinder banks can also be applied, for example, to series six-cylinder engines which are equipped with two high pressure systems.

An overall more rapid cold start with a more rapid high pressure buildup and reduced fuel consumption and reduced exhaust gas emissions is achieved in addition to the engine start method according to the invention in that either the rail volume is variable, in that, for example, the rail volume at the beginning of the starting operation is low and becomes greater only later or in that the pumping speed or pumping quantity is variable in that the pump at the beginning of the starting operation pumps a great amount or very rapidly and only later pumps slower or less.

It is understood that the foregoing description is that of the preferred embodiments of the invention and that various changes and modifications may be made thereto without departing from the spirit and scope of the invention as defined in the appended claims.

What is claimed is:

1. A method of starting an internal combustion engine operated with direct injection including an engine for a motor vehicle, the engine being subdivided into several cylinder banks with high-pressure injection systems being provided for corresponding ones of said cylinder banks, the method comprising the steps of:

after a start signal, injecting each of the cylinders of a first one of said cylinder banks in a first phase (A) of a starting operation for starting said engine while not injecting the cylinders of the remaining one(s) of said cylinder banks; and, in a subsequent second phase (B) of said starting operation, injecting those cylinders of a second one of said cylinder banks.

2. The method of claim 1, further comprising the step of injecting, in said second phase (B), all of the cylinders of the remaining ones of said cylinder banks once or several times and not injecting the cylinders of said first cylinder bank; and, thereafter, injecting all of the cylinders of all of said cylinder banks.

3. The method of claim 1, further comprising the step of injecting, in said second phase (B), all of said cylinders of all of said cylinder banks.

4. The method of claim 1, wherein said engine has three cylinder banks, injecting, in said second phase (B), various cylinders of the remaining ones of said cylinder banks and, directly thereafter, injecting all of the cylinders of all of said cylinder banks.

5. The method of claim 4, wherein the sequence of the cylinder banks, which are injected, is freely selectable.

6. A method of starting an internal combustion engine operated with direct injection including an engine for a motor vehicle, the engine being subdivided into several cylinder banks with high-pressure injection systems being provided for corresponding ones of said cylinder banks, the method comprising the steps of:

injecting each of the cylinders of a first one of said cylinder banks in a first phase (A) while not injecting the cylinders of the remaining one(s) of said cylinder banks;

in a subsequent second phase (B), injecting those cylinders of a second one of said cylinder banks; and, controlling injections into individual ones of said cylinder banks with respect to at least one of time point, frequency and sequence of said injections in dependence upon the pressure present in said high-pressure injection systems, respectively.

7. The method of claim 6, wherein said at least one of said time point, frequency and sequence of said injections is individually determined for each starting operation.

8. A control element including a read-only-memory or flash memory for a control apparatus of an internal combustion engine having at least two cylinder banks including an engine of a motor vehicle, on which control element a program is stored which can be run on a computing apparatus including a microprocessor, and is suitable for carrying out a method of starting said internal combustion engine, the method comprising the steps of:

after a start signal, injecting each of the cylinders of a first one of said cylinder banks in a first phase (A) of a starting operation for starting said engine while not injecting the cylinders of the remaining one(s) of said cylinder banks; and, in a subsequent second phase (B) of said starting operation, injecting those cylinders of a second one of said cylinder banks.

9. A control apparatus for an internal combustion engine operated with direct injection including an engine for a motor vehicle, the engine being subdivided into several cylinder banks with high-pressure injection systems being provided for corresponding ones of said cylinder banks, said control apparatus comprising:

means for injecting each of the cylinders of a first one of said cylinder banks in a first phase (A) of a starting operation for starting said engine while not injecting the cylinders of the remaining one(s) of said cylinder banks; and, in a subsequent second phase (B) of said starting operation, means for injecting those cylinders of a second one of said cylinder banks.

10. An internal combustion engine including an engine for a motor vehicle, the engine comprising:

several cylinder banks;

several high-pressure injection systems corresponding to said cylinder banks, respectively; and, control apparatus including:

means for injecting each of the cylinders of a first one of said cylinder banks in a first phase (A) of a starting operation for starting said engine while not injecting the cylinders of the remaining one(s) of said cylinder banks; and, in a subsequent second phase (B) of said starting operation, means for injecting those cylinders of a second one of said cylinder banks.

* * * * *